US009267752B1

(12) United States Patent
Malone et al.

(10) Patent No.: US 9,267,752 B1
(45) Date of Patent: Feb. 23, 2016

(54) PORTABLE RIFLE REST

(71) Applicants: Tony Malone, Chunky, MS (US); Mary Malone, Chunky, MS (US)

(72) Inventors: Tony Malone, Chunky, MS (US); Mary Malone, Chunky, MS (US)

( * ) Notice: Subject to any disclaimer, the term of this patent is extended or adjusted under 35 U.S.C. 154(b) by 0 days.

(21) Appl. No.: 14/552,561

(22) Filed: Nov. 25, 2014

(51) Int. Cl.
*F41A 23/18* (2006.01)
*F41A 23/02* (2006.01)

(52) U.S. Cl.
CPC ..... *F41A 23/18* (2013.01); *F41A 23/02* (2013.01)

(58) Field of Classification Search
CPC ..... F41A 23/18; F41A 23/26; F41A 23/02; F41A 23/00
USPC ..... 42/94; 89/37.04
See application file for complete search history.

(56) References Cited

U.S. PATENT DOCUMENTS

| | | | | |
|---|---|---|---|---|
| 3,007,581 | A | 11/1961 | Moore | |
| 4,007,554 | A * | 2/1977 | Helmstadter | 42/94 |
| 4,144,971 | A | 3/1979 | Balibrea | |
| 5,410,835 | A | 5/1995 | Vetter | |
| 5,626,379 | A * | 5/1997 | Scott | 294/143 |
| 6,499,780 | B2 | 12/2002 | Bingman | |
| 6,935,065 | B1 | 8/2005 | Oliver | |
| D622,086 | S | 8/2010 | Leung | |
| 8,590,440 | B2 | 11/2013 | Gallo | |
| 8,733,227 | B1 * | 5/2014 | Ridgeway et al. | 89/37.13 |
| 2003/0140543 | A1 * | 7/2003 | Yeargin | 42/94 |
| 2010/0122960 | A1 | 5/2010 | Bliss | |

FOREIGN PATENT DOCUMENTS

| | | |
|---|---|---|
| EP | 0 813 038 | * 12/1997 |

* cited by examiner

*Primary Examiner* — Stephen M Johnson
(74) *Attorney, Agent, or Firm* — Kyle A. Fletcher, Esq.

(57) ABSTRACT

The portable rifle rest is a portable means for the safe, secure, and convenient storage of firearms during shooting activities such as hunting or target shooting. The purpose of the portable rifle rest is to allow the shooter to temporarily place a loaded firearm into a secure position. Placement of a loaded firearm in a secure position allows the shooter the freedom to perform other activities such as entering or preparing a shooting blind or simply to rest without fear that the weapon will accidentally fall and discharge.

9 Claims, 4 Drawing Sheets

PORTABLE RIFLE REST

CROSS REFERENCES TO RELATED APPLICATIONS

Not Applicable.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sporting goods, more specifically, a device that is used during hunting and shooting activities.

SUMMARY OF THE INVENTION

The portable rifle rest is a portable means for the safe, secure, and convenient storage of firearms during shooting activities such as hunting or target shooting. The purpose of the portable rifle rest is to allow the shooter to temporarily place a loaded firearm into a secure position. Placement of a loaded firearm in a secure position allows the shooter the freedom to perform other activities such as entering or preparing a shooting blind or simply to rest without fear that the weapon will accidentally fall and discharge.

These together with additional objects, features and to those of ordinary skill in the art upon reading the following detailed description of presently preferred, but nonetheless illustrative, embodiments of the portable rifle rest when taken in conjunction with the accompanying drawings.

In this respect, before explaining the current embodiments of the portable rifle rest in detail, it is to be understood that the portable rifle rest is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable rifle rest.

It is therefore important that the claims be regarded as including such equivalent construction insofar as they do not depart from the spirit and scope of the portable rifle rest. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
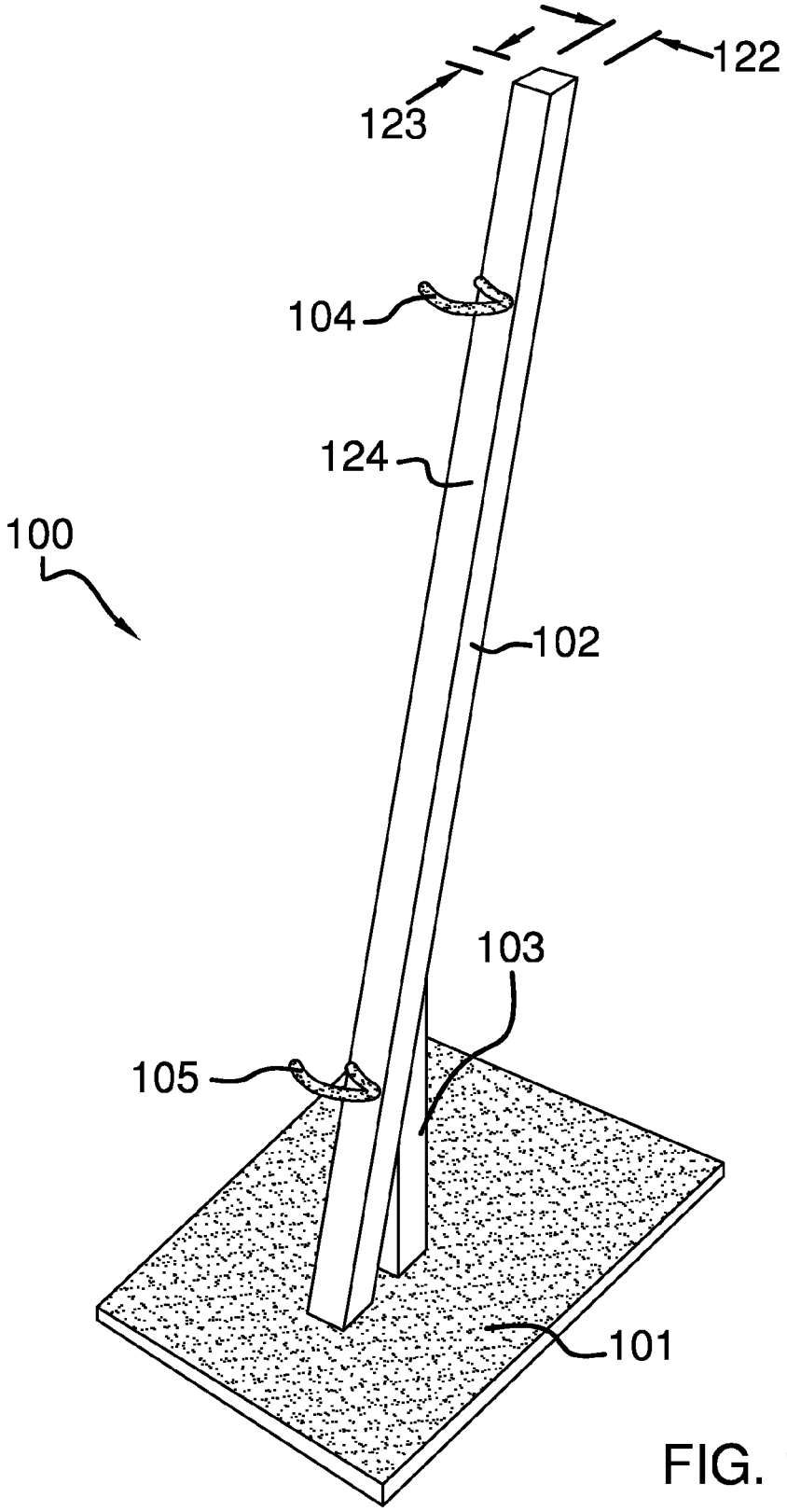
FIG. 1 is a perspective view of the portable rifle rest
Figure 2:
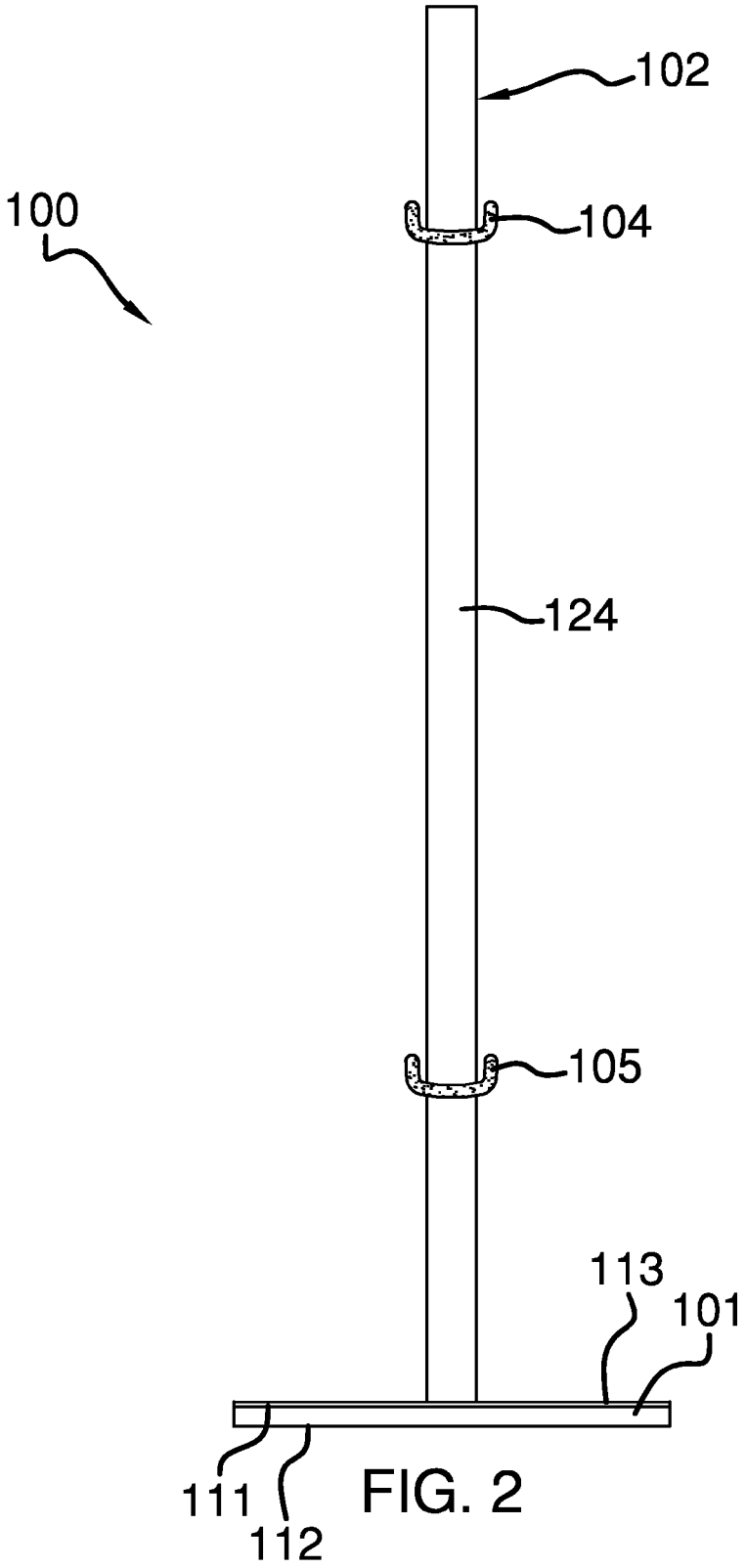
FIG. 2 is front view of the portable rifle rest
Figure 3:
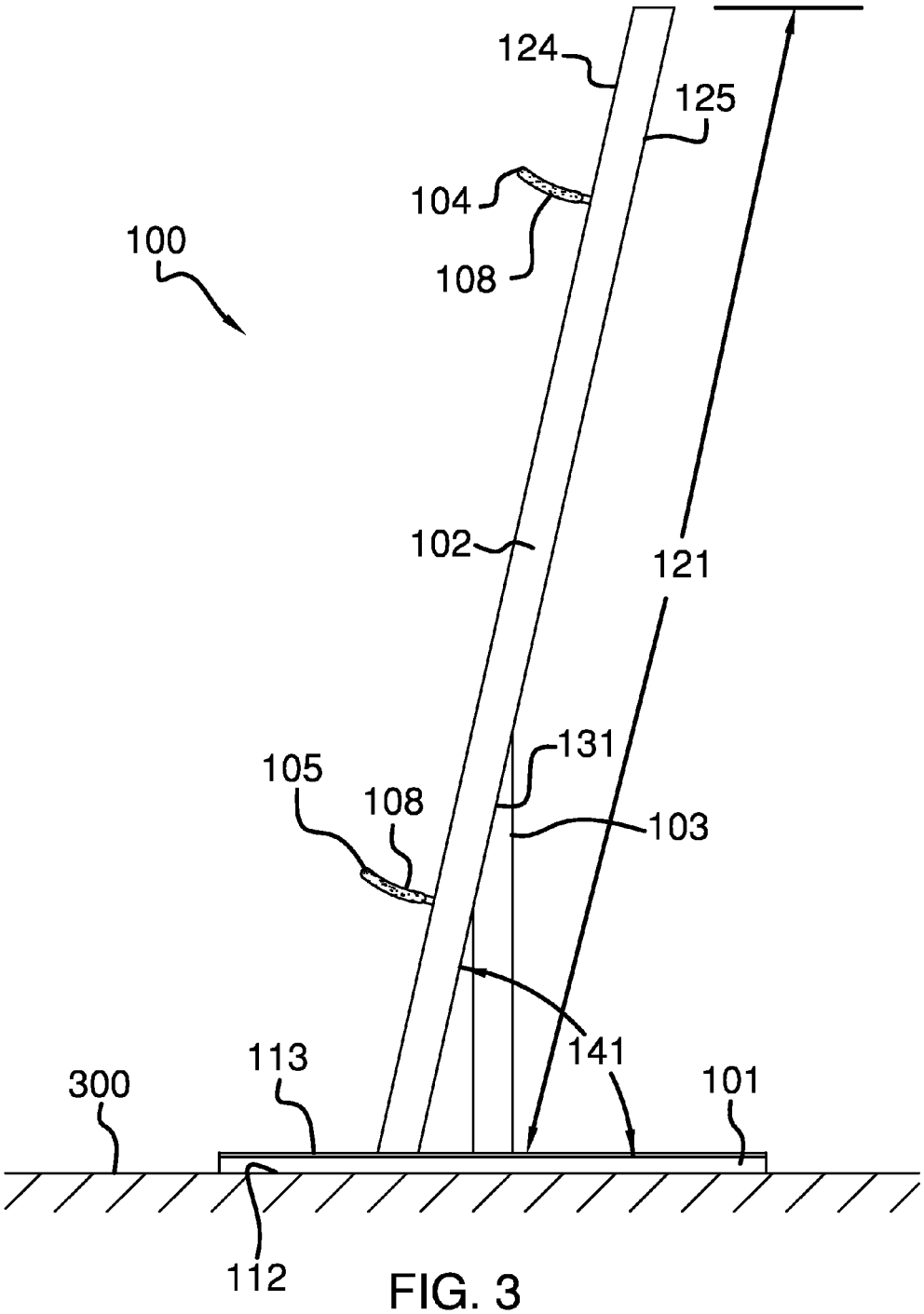
FIG. 3 is a side view of the portable rifle rest
Figure 4:
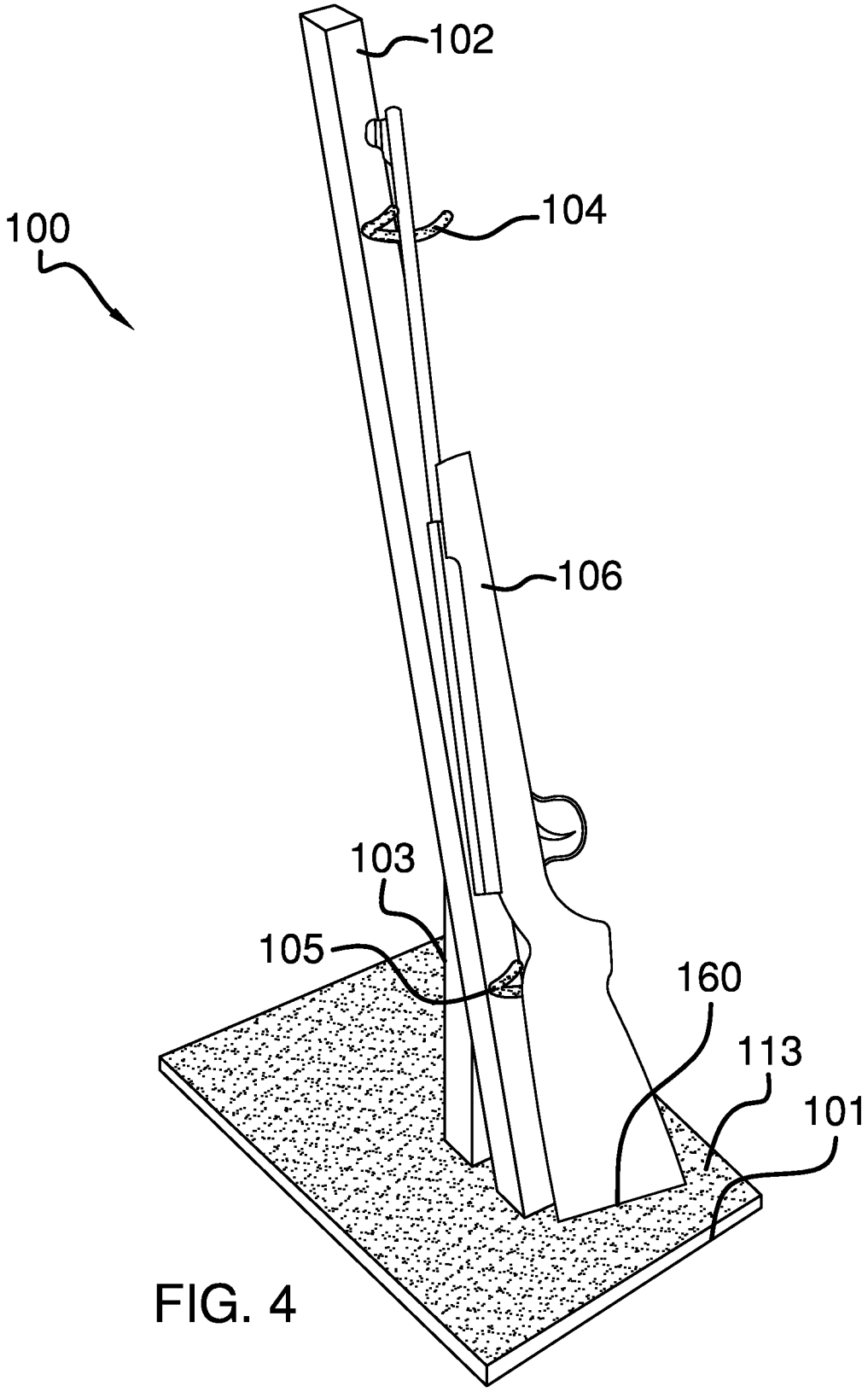
FIG. 4 is an in use view of the portable rifle rest.

As best illustrated in FIGS. 1 through 4, the 100 (hereinafter invention) generally comprises a portable rifle rest 100 (hereinafter invention) that includes a base 101, a rest 102, a support 103, and a plurality of holders.

The base 101 is rectangular in shape, and can be made from wood, molded plastic or metal. The base 101 has an identical top and bottom surface, and 4 sides. The two sides with the greatest surface area are a top face 111 and a bottom face 112 of the base 101. The bottom face 112 of the base 101 is adapted to rest on a supporting surface 300, such as the ground, while the top face is adorned and covered with a non-skid surface 113. The base 101 acts as a stable platform that allows the invention 100 to stand erect while the non-skid surface 113 on the top face 111 of the base 101 provides a secure resting spot for a firearm 106.

The rest 102 is essentially in the shape of a rectangular block and can be made from wood, molded plastic or metal. The rest 102 has dimensions of a rest length 121, a rest width 122, and a rest thickness 123. The rest length 121 of the rest 102 is between 24 and 36 inches. The rest width 122 of the rest 102 is between 3 and 5 inches. The rest thickness 123 of the rest 102 should be no less than 0.5 inches. The rest 102 is further defined with a front rest face 124 and a back rest face 125. The front rest face 124 and the back rest face 125 are faces with dimensions that are equal to the rest length 121 and the rest width 122 of the rest 102. The remaining surfaces of the rest 102 may be referred to as rest side surfaces. When in use, the firearm 106 is adapted to lie against the front rest face 124 of the rest 102.

The support 103 is attached to the back rest face 125 of the rest 102. Moreover, the support 103 attaches to the top face 111 of the base 101. The support 103 connects between the rest 102 and the base 101. The support 103 is perpendicularly engaged with respect to the top face 111 of the base 101. The support 103 includes an angled surface 131 that is secured to the back rest face 125 of the support 103. The back rest face 125 of the support 103 forms an acute angle 141 with respect to the top face 111 of the base 101. The support 103 made can be made from wood, molded plastic or metal and is in the shape of a trapezoidal prism.

A support length 132 of the support 103 is between one quarter and one half the rest length 121 of the rest 102. The acute angle 141 of the bevel cut of the top side of the support 103, as measured from horizontal, is between 60 and 80 degrees. In order for the rest 102 to attach squarely on the base 101, the angle of the bevel of the bottom side of the rest 102, as measured from horizontal, will equal 90 degrees less the angle of the beveled cut of the top side of the support 103.

In order to assemble the invention 100, the bottom side of the support 103 is attached to the base 101. The bottom side of the rest 102 is then attached to the base 101 so that the back side of the base 101 rests squarely on the beveled top side of the support 103. The rest 102 and the support 103 can be attached to the base 101 using several methods including, but not limited to: nails, wood screws, nuts and bolts, or dowel joints. The rest 102 can be attached to the support 103 using several methods including, but not limited to: glue, nails, wood screws, nuts and bolts, or dowel joints.

In one alternative embodiment, the invention 100 can be assembled so that it can be readily broken down into a form more convenient for storage or transportation. In a second alternative embodiment, the base 101, rest 102, and support 103 can be assembled using hinge mechanisms that will allow the invention 100 to collapse into an easily carried form. In a third alternative embodiment, the invention 100 can be molded in plastic as a single piece.

The final element of the invention 100 is a plurality of holders 108 that are attached to the rest 102. The plurality of holders 108 further secure the firearm 106 by holding the firearm 106 securely in position should the invention 100 be accidentally knocked while in use. The plurality of holders 108 are affixed to and extend from the front rest face 124 of the rest 102. In the embodiment of the invention 100 shown in FIGS. 1-4, a first rubber coated hook 104 and a second rubber coated hook 105 are screwed into the face of the rest 102 to act as the plurality of holders 108.

To use the invention 100, a shooter places the assembled invention 100 onto supporting surface 300, and places a stock 161 of the firearm 106 on the base 101 of the invention 100. The firearm 106 can then be placed against the rest 102 underneath the plurality of holders 108 that are provided.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable rifle rest comprising:

a base, a rest, a support, and a plurality of holders;

wherein the base is adapted to be positioned on a ground surface;

wherein a firearm is adapted to be positioned against both the base and the rest;

wherein the portable rifle rest is adapted to support said firearm at an acute angle whilst said firearm is or is not loaded, and whilst said firearm is about to be used or between uses;

wherein the base is rectangular in shape, and is further defined with a top face and a bottom face;

wherein the bottom face of the base is adapted to rest on a supporting surface, while the top face is adorned and covered with a non-skid surface;

wherein the rest is a rectangular block and can be made from wood, molded plastic or metal; wherein the rest has dimensions of a rest length, a rest width, and a rest thickness;

wherein the rest is further defined with a front rest face and a back rest face; wherein the front rest face and the back rest face are faces with dimensions that are equal to the rest length and the rest width of the rest;

wherein the firearm is adapted to lie against the front rest face of the rest; wherein a stock of said firearm is adapted to be placed against the base;

wherein the support is attached to the back rest face of the rest; wherein the support attaches to the top face of the base; wherein the support connects between the rest and the base; wherein the support is perpendicularly engaged with respect to the top face of the rest;

wherein the support includes an angled surface that is secured to the back rest face of the support; wherein the back rest face of the support forms said acute angle with respect to the top face of the base;

wherein a support length of the support is between one quarter and one half the rest length of the rest; wherein the acute angle of a bevel cut of the top side of the support, as measured from horizontal, is between 60 and 80 degrees.

2. The portable rifle rest according to claim 1 wherein the rest length of the rest is between 24 and 36 inches.

3. The portable rifle rest according to claim 2 wherein the rest width of the rest is between 3 and 5 inches.

4. The portable rifle rest according to claim 3 wherein the rest thickness of the rest should be no less than 0.5 inches.

5. The portable rifle rest according to claim 1 wherein the plurality of holders that are attached to the rest are further defined with a first rubber coated hook and a second rubber coated hook.

6. The portable rifle rest according to claim 5 wherein the first rubber coated hook and the second rubber coated hook are screwed into the face of the rest; wherein the first rubber coated hook is positioned above the second rubber coated hook.

7. A portable rifle rest comprising:

a base, a rest, a support, and a plurality of holders;

wherein the base is adapted to be positioned on a ground surface;

wherein a firearm is adapted to be positioned against both the base and the rest;

wherein the portable rifle rest is adapted to support said firearm at an acute angle whilst said firearm is or is not loaded, and whilst said firearm is about to be used or between uses;

wherein the base is rectangular in shape, and is further defined with a top face and a bottom face;

wherein the bottom face of the base is adapted to rest on a supporting surface, while the top face is adorned and covered with a non-skid surface;

wherein the rest is a rectangular block and can be made from wood, molded plastic or metal; wherein the rest has dimensions of a rest length, a rest width, and a rest thickness;

wherein the rest is further defined with a front rest face and a back rest face; wherein the front rest face and the back rest face are faces with dimensions that are equal to the rest length and the rest width of the rest; wherein the firearm is adapted to lie against the front rest face of the rest; wherein a stock of said firearm is adapted to be placed against the base;

wherein the support is attached to the back rest face of the rest; wherein the support attaches to the top face of the base; wherein the support connects between the rest and the base; wherein the support is perpendicularly engaged with respect to the top face of the base; wherein the support includes an angled surface that is secured to the back rest face of the base; wherein the back rest face of the support forms said acute angle with respect to the top face of the base;

wherein a support length of the support is between one quarter and one half the rest length of the rest; wherein the acute angle of a bevel cut of the top side of the support, as measured from horizontal, is between 60 and 80 degrees.

8. The portable rifle rest according to claim 7 wherein the rest length of the rest is between 24 and 36 inches; wherein the rest width of the rest is between 3 and 5 inches; wherein the rest thickness of the rest should be no less than 0.5 inches.

9. The portable rifle rest according to claim 7 wherein the plurality of holders that are attached to the rest are further defined with a first rubber coated hook and a second rubber coated hook; wherein the first rubber coated hook and the second rubber coated hook are screwed into the face of the rest; wherein the first rubber coated hook is positioned above the second rubber coated hook.

* * * * *